US005256059A

United States Patent [19]

Knippenberg

[11] Patent Number: 5,256,059

[45] Date of Patent: Oct. 26, 1993

[54] TORCH OR CANDLE

[75] Inventor: Carlo M. Knippenberg, Mönchengladbach, Fed. Rep. of Germany

[73] Assignee: Constrade Aktiengesellschaft, Vaduz, Liechtenstein

[21] Appl. No.: 855,713

[22] Filed: Mar. 20, 1992

[30] Foreign Application Priority Data

Mar. 30, 1991 [EP] European Pat. Off. ..... 91105120.9

[51] Int. Cl.[5] ..... F23D 3/16

[52] U.S. Cl. ..... 431/289; 431/288

[58] Field of Search ..... 431/288, 326, 289, 126, 431/298

[56] References Cited

U.S. PATENT DOCUMENTS

| | | | |
|---|---|---|---|
| 2,627,174 | 2/1953 | Weglin | 431/288 X |
| 3,283,546 | 11/1966 | Matsui | 431/288 X |
| 3,428,409 | 2/1969 | Summers | 431/289 |
| 3,466,135 | 9/1969 | Summers | 431/289 |

FOREIGN PATENT DOCUMENTS

| | | |
|---|---|---|
| 2463803 | 2/1981 | France . |
| 782220 | 9/1957 | United Kingdom . |
| 1238214 | 7/1971 | United Kingdom . |

*Primary Examiner*—Larry Jones
*Attorney, Agent, or Firm*—Anderson Kill Olick & Oshinsky

[57] ABSTRACT

The torch or candle includes a fire retarding coil, which is passed helically around a sheathed burning body, which ensures that regulated burning takes place, while also limiting one-sided burning.

15 Claims, 1 Drawing Sheet

TORCH OR CANDLE

BACKGROUND OF THE INVENTION

1. Field of the Invention

The present invention relates to a torch or candle according to the preamble of claim 1.

2. Description of the Related Art

Numerous different constructions of such torches are known from the prior art, but always have characteristics evaluated very negatively by the user.

Firstly there is the very pronounced dripping and flowing away of the paraffin liquefied by the flame and as an end result the paraffin spread over the ground or plants and which then resolidifies. It is tiresome and time-consuming to remove this contamination. Secondly the burning behaviour disturbed in this way necessarily significantly shortens the burning time by the loss of the unused, flowing down paraffin. Thirdly the often cotton wick does not function when there is even a slight draught or the like.

SUMMARY OF THE INVENTION

The problem of the present invention is to so improve the aforementioned torch or candle that the aforementioned disadvantages are reliably avoided, i.e. a torch is obtained, which has an undisturbed, reliable burning behaviour with a long burning time, without the liquefied paraffin smothering the flame or dirtying the ground.

This problem is surprisingly solved by the torch or candle characterized in claim 1. Therefore the invention makes use of a fire retarding coil, which is passed helically around the sheathed burning body, which ensures that regulated burning takes place, whilst also limiting one-sided burning. It is clear that burning is retarded in the vicinity of the coil, whilst the helically provided gap ensures the continuation of burning, because it is not covered by the fire retarding coil.

Advantageously the coil is made from wrapping paper, which is impregnated with sodium and/or potassium silicate. Both of these quenching agents ensure a good adhesion to the sheathed burning body. However, the Expert can also use other chemicals.

For the case that the coil pitch is constant and the gap remains constant considered axially, i.e. the individual coil turns have the same reciprocal spacing, a uniform burning is ensured. However, if the gap or the spacing between the individual coil turns is modified by changing the pitch, the burning time can be increased or decreased.

Further advantages and features can be gathered from the claims and can be of inventive significance in conjunction with the main claim.

An embodiment of the invention is described in greater detail hereinafter relative to the drawing.

DESCRIPTION OF THE PREFERRED EMBODIMENTS

Figure 1:
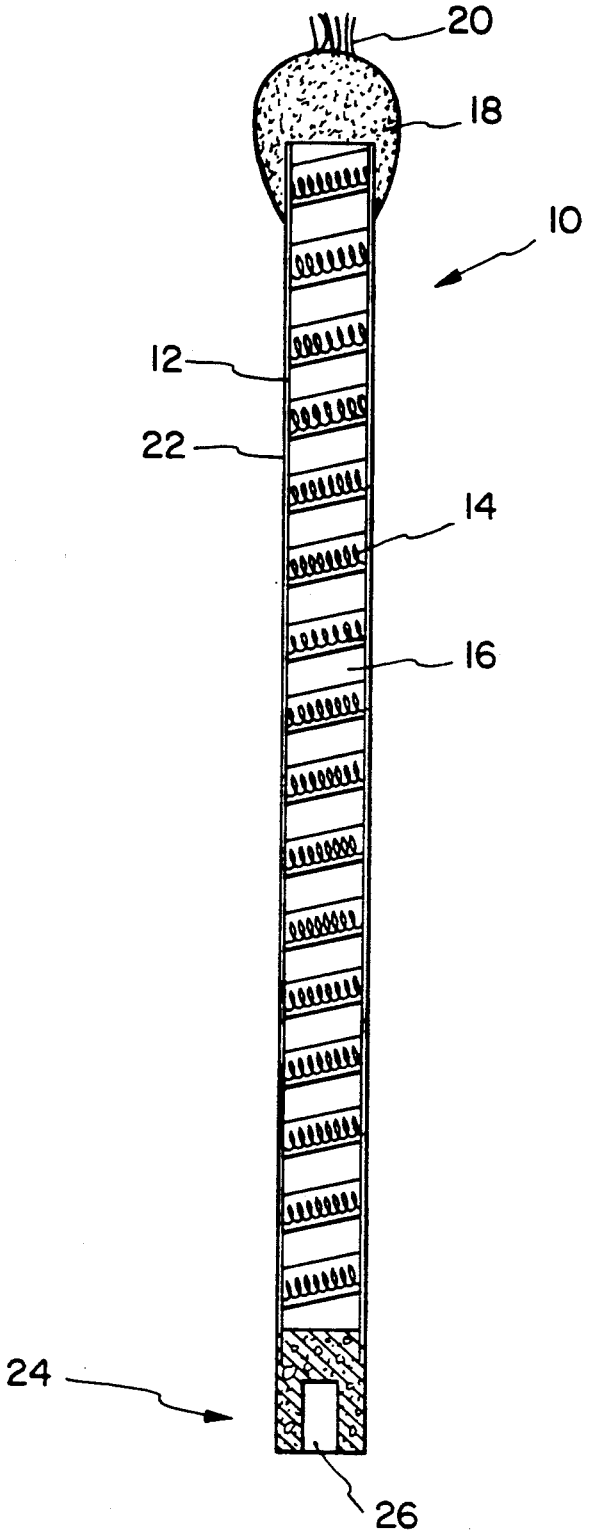
FIG. 1 is diagrammatic cross-sectional view of a torch according to the invention.

The torch according to the invention is designated in general terms by 10. In the preferred embodiment it is shaped in the form of a per se known match. It has a length of 60 cm, in the case of a square cross-section of the burning body of 32×32 mm. The decorative sleeve 22 is wood-coloured and is made from cardboard and is placed over the burning body provided with a coil 14 and the jacket 12. The decorative sleeve 22 follows the regulated burning of the square burning body. At the upper end of the burning body there is a roughly circular, red ignition head 18, which comprises a mixture of sawdust and paraffin, together with a certain number of paraffin-impregnated wicks 20 on the upper head part, which facilitate the igniting of the igniting head 18. The positioning of the wicks 20 in the upper area serves to bring about a uniform distribution of the flame to all sides. During tests no dripping of paraffin from the igniting head 18 was observed.

The termination at the lower end of the torch 10 is formed by a bonded in concrete block 24, which has a lower, elongated recess or bore 26. Into said bore can be inserted a not shown wooden bar, which is pointed at its outer end, so that it can be easily introduced into the soil or the like. The concrete block 24 ends the burning of the torch.

It is clear that other sizes, shapes and colours are also suitable for an inventive torch.

I claim:

1. Torch (10) or candle with a burning body formed from paraffin and a paper jacket (12) serving as the wick, characterized by a fire retarding coil (14), which is placed helically around the sheathed burning body in such a way that a helical gap (16) is formed.

2. Torch or candle according to claim 1, characterized in that the coil (14) is made from wrapping paper, which is impregnated with sodium and/or potassium silicate.

3. Torch or candle according to claim 1, characterized in that the pitch of the coil (14) is constant over the length of the torch (10).

4. Torch or candle according to claim 1, characterized by an igniting head (18) comprising a mixture of sawdust and paraffin, and a specific number of paraffin-impregnated wicks (20) on the igniting head (18).

5. Torch or candle according to claim 1, characterized in that the paraffin burning body has a circular cross-section.

6. Torch or candle according to claim 1, characterized in that the jacket (12) is made from corrugated paper.

7. Torch or candle according to claim 1, characterized in that the burning body provided with the jacket (12) and the coil (14) is surrounded by a decorative sleeve (22).

8. Torch or candle according to claim 1, further comprising a wooden bar and characterized in that at the lower end of the torch (10) is bonded in a concrete block (24) with a bore (20), in which can be inserted into the wooden bar.

9. Torch or candle according to claim 8, characterized in that the outer end of the wooden bar is pointed.

10. Torch or candle according to claim 1, characterized in that the burning body has a length between 40 and 80 cm, and the square cross-section of the burning body is between 20×20 and 40×40 cm, the shape being that of a per se known match.

11. Torch or candle according to claim 1, characterized in that the fire retarding coil (14) is pressed onto the jacket.

12. Torch or candle according to claim 1, characterized in that the pitch of the coil (14) changes over the length of the torch (10).

13. Torch or candle according to claim 1, characterized in that the paraffin burning body has a square cross-section.

14. Torch or candle according to claim 1, characterized in that the jacket (12) is made from paper board.

15. Torch or candle according to claim 1, characterized in that the burning body has a length of 60 cm and the square cross-section of the burning body is 32×32 cm, the shape being that of a per se known match.

* * * * *